United States Patent [19]

Dowd

[11] Patent Number: 5,064,701

[45] Date of Patent: Nov. 12, 1991

[54] MULTI-SIDED PLACEMAT

[76] Inventor: Debra Dowd, 324 Jefferson Ave., Salem, Mass. 01970

[21] Appl. No.: 419,210

[22] Filed: Oct. 10, 1989

[51] Int. Cl.[5] ..... A47G 23/00

[52] U.S. Cl. ..... 428/46; D 6/613; D 6/616; 428/52; 428/102; 428/195.

[58] Field of Search ..... 428/46, 52, 102, 195; D 6/613, 616; 281/51

[56] References Cited

U.S. PATENT DOCUMENTS

| | | | |
|---|---|---|---|
| 3,920,870 | 11/1975 | Ackerman et al. | 428/46 |
| 3,983,277 | 9/1976 | Ackerman et al. | 428/46 |
| 4,120,100 | 10/1978 | Dugan | 428/11 X |
| 4,214,023 | 7/1980 | Day | 428/11 |
| 4,280,241 | 7/1981 | Pfaff | 281/51 X |
| 4,596,726 | 6/1986 | Wrzalinski | 428/11 |

*Primary Examiner*—Henry F. Epstein

*Attorney, Agent, or Firm*—Wolf, Greenfield & Sacks

[57] ABSTRACT

A placemat, including multiple sheets of material connected in such manner that the sheets may be folded so as to present a different graphic designs. Each sheet is divided into two leaves, each of the leaves being attached to an adjacent leaf from an adjacent sheet of material.

6 Claims, 1 Drawing Sheet

MULTI-SIDED PLACEMAT

BACKGROUND OF THE INVENTION

The invention pertains to a multi-sided placemat which covers a portion of the surface of a table or other flat surface. The placemat is composed of multiple sheets of material which may be folded so as to present different graphic displays.

The use of placemats to protect the surface of a table, for example, during a meal, is widely known. The most common and simplest type of placemat is merely a woven piece of cloth which is identical on both sides thereof. Thus, the user must change placemats in order to change the graphic display.

U.S. Pat. No. 3,920,870 to Ackerman, et al is directed to a more complicated decorative placemat in which an envelope-like structure is formed from sheets of clear plastic and foamed polyvinyl chloride. The user can insert in the envelope a sheet of material bearing a desired graphic pattern and then close it. Thus, this type of placemat provides the user with the ability to change the graphic pattern displayed. A disadvantage of this construction is that it requires the user to open the envelope, remove the display sheet, and insert a different display sheet each time the graphic pattern is to be charged. Further, the sheets with various graphic patterns must be stored in a separate location from the envelope when the envelope is in use, and therefore may be easily misplaced.

Accordingly, it is an object of the present invention to provide a multi-sided placemat which provides multiple, graphic patterns and has no detachable parts.

SUMMARY OF THE INVENTION

The objects are achieved in accordance with the present invention by providing a plurality of sheets of material, each having a different graphic design, dividing each of these sheets of material into a pair of equal-sized leaves and then attaching a leaf of one sheet to the leaf of an adjacent sheet so that adjacent pairs of leaves are connected in face-to face relationship to form a page. The resulting assembly permits the user to select any one of the different patterns to be exposed as the decoration of the placement.

An advantage of the present invention is that multiple designs are incorporated into a single placemat, thus permitting the placemat to be adapted to different decors.

A further advantage of this invention is that the placemat permits the user to simply fold it over to expose a different design when a previous graphic design has been soiled during use. Thus, the placemat of the present invention requires less frequent cleaning.

Finally, the present invention does not require any insertion or removal steps in order to change the graphic design which is exposed. As a consequence, the placemat of the present invention does not include any additional pieces or parts which would require separate storage.

Other objects and advantages of the invention will be apparent from the following description in conjunction with the accompanying drawings.

DESCRIPTION OF PREFERRED EMBODIMENTS

Figure 1:
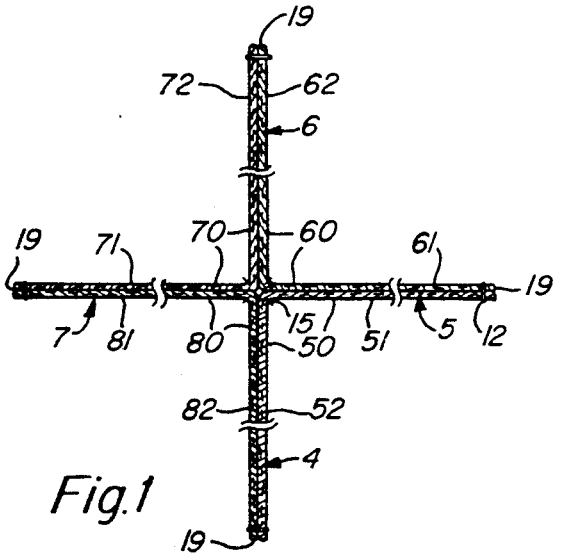
FIG. 1 is a cross-sectional view, showing a first embodiment of the present invention, in which the placemat comprises four sheets of material.
Figure 2:
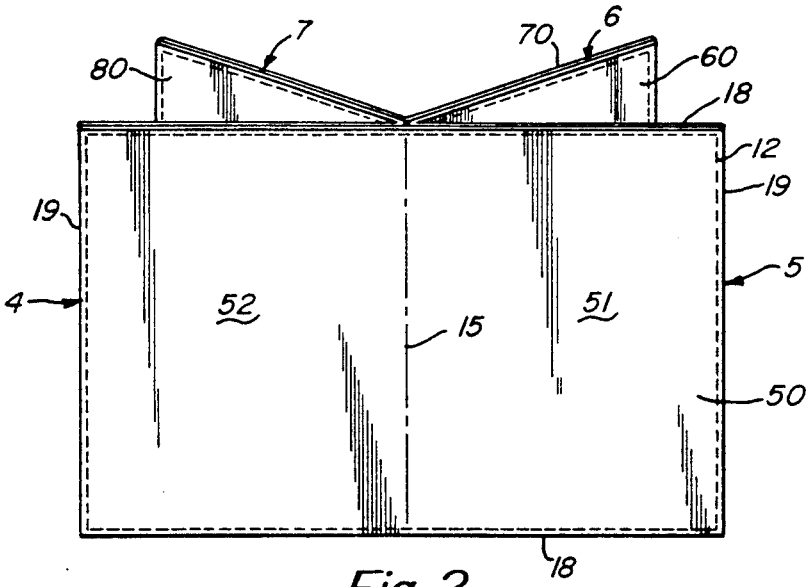
FIG. 2 is a perspective view of the first embodiment shown in FIG. 1.

The embodiment of the present invention shown in FIGS. 1 and 2 is composed of four sheets of material, 50, 60, 70, and 80. Each of the sheets of material presents a different graphic display, i.e., different colors, pictures or patterns. Each sheet of material, 50, 60, 70, and 80, is divided into two leaves, 51 and 52, 61 and 62, 71 and 72, 81 and 82, respectively, by bisecting lines 15. Leaf 51 of sheet 50 is connected to an adjacent leaf 61 of sheet 60, so that their respective bisecting lines meet one another. One method of connecting the leaves is by sewing the sheets by the stitching line 12 as shown in FIG. 2, wherein the adjacent leaves are sewn together along their side edges 18, which are transverse to the bisecting lines 15, and along their end edges 19, which are parallel to the bisecting lines 15. Thus, leaves 51 and 61, together form a two-ply, page 5. In a similar manner, leaves 62 and 72 form page 6; leaves 71 and 81 form page 7; and leaves 52 and 82 form page 4.

Figure 3:
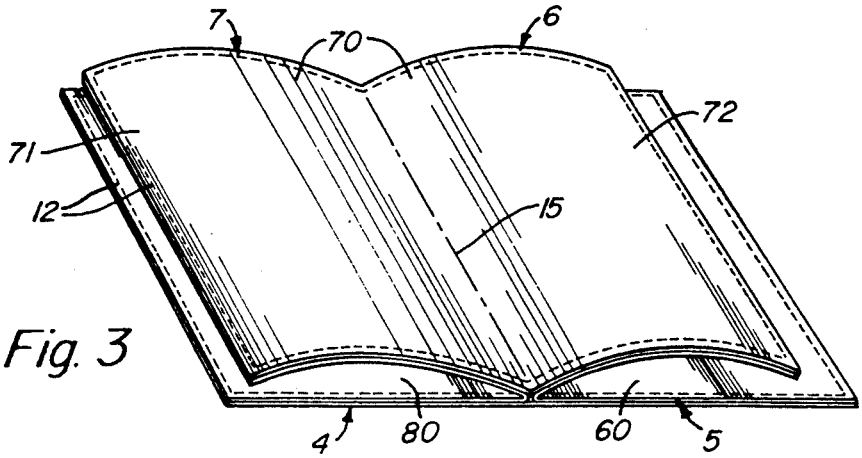
FIG. 3 is a second perspective view of the first embodiment shown in FIG. 1.

Referring to FIG. 3, the graphic pattern of sheet 70, which includes leaves 71 and 72, is exposed. When the graphic pattern of sheet 60 is desired, page 6 is flipped to the left about bisecting line 15 to expose leaves 62 and 61. At the same time, page 4 may be flipped so that it lies beneath page 5, thus presenting a smooth, even surface, i.e., having an equal number of pages on each side of bisecting line 15. On the other hand, if the graphic pattern of sheet 80 is desired, page 7 is flipped to the right, to expose leaves 81 and 82 of sheet 80. In this event, page 5 may be folded underneath page 4 in order to achieve a smoother surface. Finally, if the graphic pattern of sheet 50 is desired, the entire placemat may merely be turned over (flipped 180 degrees) without turning any of the pages 4, 5, 6, or 7.

Figure 4:
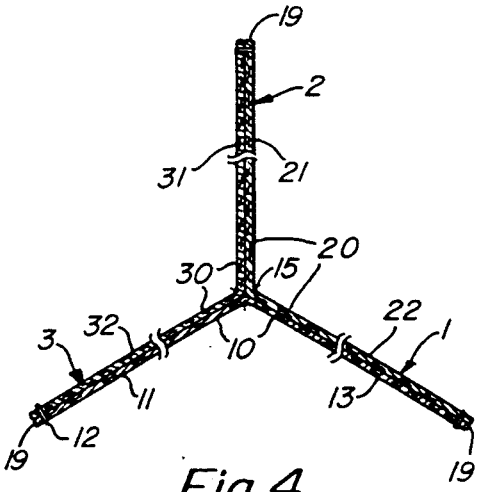
FIG. 4 is a cross sectional view, showing a second embodiment of the present invention, in which the placemat comprises three sheets of material.

The placemat of the present invention is not limited to four sheets of material. The second embodiment shown in FIG. 4, includes three sheets of material, 10, 20, and 30. In this embodiment, sheet 10 is divided into leaves 11 and 13; sheet 20 is divided into leaves 22 and 21; and sheet 30 is divided into leaves 31 and 32. Leaves 21 and 31 are attached to one another; leaves 32 and 11 are attached to one another; as are leaves 13 and 22. Thus, the three sheets 10, 20, and 30 form pages 1, 2, and 3. Each pair of adjacent leaves may be attached to one another in a manner similar to that discussed with regard to the first embodiment.

The specific embodiments discussed above are not meant to limit the present invention. As is readily apparent, the placemat may be made with essentially any number of sheets greater than 3, and the adjacent leaves may be attached to one another by methods other than stitching, such as thermo welding when the sheets are made of thermoplastic material.

What is claimed is:

1. A multifaced placemat comprising at least three sheets of readily foldable placemat material of the same size and shape and each sheet being symmetrical about a center line dividing each sheet into two leaves, said sheets being superimposed on top of one another in a stack with their centerlines lying coextensive and parallel to one another, adjacent pairs of said leaves of separate sheets being attached together in a face to face relationship along substantially the entire distance of outer edges of said adjacent pairs of leaves from one junction of the outer edges and the centerline to an opposing junction of the outer edges and the center line so that the leaves together form a page that may be flipped over along the centerline to invert the page, and a graphic display carried on each of the sheets so that the displays of the sheets may be selectively exposed by orienting any one of a plurality of sheets on the top of the stack.

2. A multifaced placemat as defined in claim 1 wherein the sheets are rectangular.

3. A multifaced placemat as defined in claim 1 wherein each sheet carries a different graphic display.

4. A multifaced placemat as defined in claim 3 wherein the sheets are a textile material and the adjacent pairs of said leaves are attached along at least said outer edges by stitching.

5. A multifaced placemat as defined in claim 3 wherein the sheets are attached along at least said outer edges by material welding techniques.

6. A multifaced placemat as defined in claim 1 comprising four sheets of material.

* * * * *